US005480499A

United States Patent [19]

Wangerin et al.

[11] Patent Number: 5,480,499

[45] Date of Patent: Jan. 2, 1996

[54] METHOD FOR GUIDING A STEEL STRIP DURING ITS PASSAGE THROUGH A CONTINUOUS TREATMENT PLANT

[75] Inventors: Gerhard Wangerin, Langenfeld; Withold Richert, Hückelhoven, both of Germany

[73] Assignee: SMS Schloemann-Siemag Aktiengesellschaft, Dusseldorf, Germany

[21] Appl. No.: 188,192

[22] Filed: Jan. 26, 1994

[30] Foreign Application Priority Data

Feb. 1, 1993 [DE] Germany ..... 43 02 698.2

[51] Int. Cl.[6] ..... B65H 23/26

[52] U.S. Cl. ..... 148/657; 266/102; 226/189; 226/197

[58] Field of Search ..... 148/657; 266/102, 266/103, 104, 106–113; 226/189, 197

[56] References Cited

U.S. PATENT DOCUMENTS 1,828,036 10/1931 Fahrenwald ..... 266/102
4,497,674 2/1985 Ikegami et al. ..... 266/102

*Primary Examiner*—Sikyin Ip
*Attorney, Agent, or Firm*—Friedrich Kueffner

[57] ABSTRACT

A method of guiding a steel strip during its passage through a continuous strip treatment plant equipped with a series of treatment stations, wherein the travel direction and/or travel track of the strip can be adjusted as desired and/or the strip is turned over as desired for making it possible to carry out a visual inspection of the strip. The method includes introducing the strip into a strip turning tower and guiding the strip, similar to a vertical looping storage unit, over vertically spaced-apart upper and lower guide rollers in order to twist the strip from roller to roller by a certain angle, such that any desired twisting angle can be adjusted between strip entry and strip exit of the strip turning tower. An arrangement for carrying out the method includes a strip turning tower constructed with a plurality of upper and lower strip guide rollers arranged vertically spaced apart from each other, wherein the rollers are turned in travel direction of the strip from roller to roller in the same direction relative to the strip inlet axis by angle values which add up to 180°, such that the strip is twisted by a partial angle value as it travels through a pair of rollers formed by an upper and a lower roller, and the strip is turned from the bottom side thereof and vice versa when the sum of all twisting angle values is 180°.

6 Claims, 8 Drawing Sheets

METHOD FOR GUIDING A STEEL STRIP DURING ITS PASSAGE THROUGH A CONTINUOUS TREATMENT PLANT

BACKGROUND OF THE INVENTION

1. Field of the Invention

The present invention relates to a method and an arrangement for guiding a steel strip during its passage through a continuous strip treatment plant equipped with a series of treatment stations, wherein the travel direction and/or travel track of the strip can be adjusted as desired and/or the strip is turned over as desired from the bottom side to the top side and vice versa for making it possible to carry out a visual inspection of the strip.

2. Description of the Related Art

A known treatment plant for steel strip includes, for example, stations for a continuous sequence of treatment steps, such as degreasing, annealing, galvanizing, cold finishing, varnishing, checking, winding, etc. In such a hot galvanizing and varnishing plant, an example of which is shown in FIG. 1, the so-called "good side" of the strip is turned over from the bottom side to the top side, in order to make it accessible for a check by a visual inspection, wherein the bottom side of the strip emerging from the galvanizing bath initially continues to be the bottom side of the strip in the continuous travel direction of the strip. During the cold finishing step, for example, toughening of the top side of the strip and during the final coiling step, the bottom side of the strip must then be turned over to the top side of the strip for a continuous visual inspection.

For this purpose, the strip is guided vertically upwardly into a steel structure underneath the high bay roof and in longitudinal direction over the plant components. The strip is at the end of the bay guided vertically downwardly and is then returned horizontally against the strip travel direction of the entry portion of the plant for further treatment and for coiling. The strip is conveyed closely underneath the roof of the bay which is approximately 40 meters high through the exit group with run-out looping tower and further through the varnishing unit. This requires a long, stable and high steel structure with support rollers for guiding the strip and a crane underneath the strip for handling the plant components arranged below the strip. The high bay required for this purpose is very long, for example, 150 meters. This results in a further disadvantage because the long horizontal stretch of the strip guidance located at a high location may lead to strip running problems and damage to the strip on the support rollers.

SUMMARY OF THE INVENTION

Therefore, it is the primary object of the present invention to provide a method and an arrangement for guiding a steel strip during its passage through a continuous strip treatment plant in which the above-described difficulties, particularly in the transfer of the strip in the area of the roof structure of the bay, are avoided and, as a consequence, the large structural length of the bay is significantly reduced and an improved strip guidance, preferably while maintaining the travel direction of the strip through the plant, is simultaneously facilitated. Moreover, the method and the arrangement should make it possible without problems to adjust the travel direction of the strip as desired and to provide a track configuration, for example, with parallel displacement.

In accordance with the present invention, the method of the above-described type includes introducing the strip into a strip turning tower and guiding the strip, similar to a vertical looping storage unit, over vertically spaced-apart upper and lower guide rollers and to twist the strip from roller to roller by a certain angle, such that any desired twisting angle can be adjusted between strip entry and strip exit.

In accordance with a further development, the strip is twisted by an angle $\phi$ of 180°, such that, at the end of the deflections of about 180°, the bottom side of the strip at the inlet into the first roller of the strip turning tower is turned over to the top side of the strip at the exit from the last roller, and vice versa.

In accordance with an advantageous feature, the strip is guided in the strip turning tower within a relatively short horizontal stretch over guide rollers arranged at the top and the bottom and is twisted from roller to roller by an angle $\phi$, so that, in the case of a deflection about the last lower roller of altogether 180°, the bottom side of the strip at the inlet is turned over to the top side of the strip at the exit. This also results in a shorter structural length and a lower structural height of the bay as well as in a strip guidance which can be better controlled. Another advantage is the fact that, if necessary, the strip travel direction through the entire plant can be maintained unchanged, so that a better general arrangement and better control possibilities of the individual stations of the continuous strip treatment plant are achieved.

However, the strip can also be adjusted so as to be changeable in its travel direction or the strip can be guided with parallel displacement of its travel tracks through portions of the plant.

The twisting of the strip within the strip turning tower causes increased stresses at the edge of the strip. These stresses must be within the elastic range and are compensated by suitable measures. For this purpose, a feature of the present invention provides that the permissible twisting angle $\phi$ of the strip between an upper roller and a lower roller is determined by the ratio of the free length L of the strip between the two rollers relative to the strip width B and the resulting permissible edge stress $\sigma$ of the strip.

Another measure according to the present invention for reducing the edge stresses of the strip during twisting between two rollers is the use of cambered rollers in the strip turning tower.

In this regard, another development provides that the diameter difference D—D' of a roller which determines the camber corresponds approximately to the value of the increase in length of the edge $\delta L$ which causes an elongation of the edge regions of the strip and is caused by the twisting of the strip by an angle $\phi$ at a given free strip length L of the strip between a pair of rollers.

In accordance with an additional development, it may be provided that the differences in length or stress of the strip within the strip turning tower are compensated by correcting the vertical distances between the lower rollers and the upper rollers which cooperate with the lower rollers. This makes the arrangement of an additional looping storage unit unnecessary.

If it is necessary to provide a parallel displacement of the travel tracks of the strip, another development of the present invention provides that the strip is swung in the turning tower as it travels through a first group of rollers at an angle which deviates from the direction of its inlet track and is swung back in a second group of guide rollers into the original direction of its inlet track after traveling through a straight intermediate stretch whose length corresponds to the value of the lateral displacement.

This development of the invention makes it possible that, for compensating a lateral displacement caused by the guide rollers during turning of the strip, the strip is twisted in a first group of guide rollers by at least an angle of more than 180°, the strip is then guided at an angle β relative to the strip inlet axis x—x from the last lower roller along a straight stretch in the direction toward the strip exit axis y—y by the value S of the lateral displacement into a second group of guide rollers and is swung in the second group of guide rollers by an angle into the strip exit axis y—y which is coaxial with the direction of the strip inlet axis x—x. This measure makes it possible to return the strip within the tower while maintaining the strip travel track from beginning to end through the center of the plant. As is common in looping towers, means for the concentric control of the strip are provided in front of and behind the strip turning tower.

An arrangement for guiding a steel strip in a treatment plant for steel strip, wherein the plant includes stations for continuous sequences of treatment steps, such as degreasing, annealing, galvanizing, cold finishing, varnishing, checking, winding, etc. for carrying out the method according to the present invention, includes a strip turning tower constructed in the manner of a vertical looping storage unit with a plurality of upper and lower strip guide rollers arranged vertically spaced apart from each other, wherein the rollers are turned in travel direction of the strip from roller to roller in the same direction relative to the strip inlet axis x—x by angle values $\phi_1$ to $\phi_n$ which may be cumulative up to 180°, such that the strip is twisted by a partial angle value $\phi$ as it travels around a pair of rollers formed by an upper roller and a lower roller, and the strip is turned from the bottom side to the top side and vice versa if the sum of all twisting angle values $\phi_1$ to $\phi_n$ is 180°. Since the strip has contact with each roller over almost 180°, a good guidance of the strip and a gentle treatment of the strip surface are achieved.

In accordance with an additional development, the upper guide rollers may include means for adjusting the vertical distance to the lower rollers. As a result, differences in length of the strip within the strip turning tower can be compensated in a simple manner without requiring an additional looping storage unit. Moreover, another development may provide that the upper rollers of the turning unit include means for adjusting and preferably keeping constant the tension condition of the traveling strip. Such means may be, for example, hydraulic piston-cylinder units which act on the upper rollers for maintaining a predetermined tension condition of the traveling strip. The means for compensation of length and tension may form a unit.

By providing cambered guide rollers, the increased edge stresses of the strip are effectively reduced, and the strip guiding properties of the rollers are additionally improved. Preferably, the diameter difference between center and end face of a cambered roller corresponds approximately to the value of the edge length increase of the strip resulting from twisting of the strip by an angle $\phi$ at a given strip width and distance between the axes of the rollers. Another advantage of this measure is that it is uncomplicated.

In accordance with a special further development, the strip turning tower includes two separate groups of pairs of rollers which are connected to each other through a straight stretch of the strip in the direction of a strip exit axis y—y which extends coaxially with the strip inlet axis x—x, wherein the sum of the angle values of both groups is a cumulative 180°. This development ensures that the strip travels in a line through the plant center from entry to exit of the strip while maintaining the strip travel.

Another feature provides to extend the straight stretch of the strip travel by a length which corresponds to the value of a given distance between two parallel tracks. As a result, any parallel displacement of the strip during transport of the strip can be adjusted. By selecting an appropriate combination of twisting angles, it is additionally possible to adjust any desired strip travel direction.

In accordance with another important further development, the upper and lower rollers are arranged relative to each other in the vertical projection thereof in such a way that the side lines of two rollers which guide a common strip section and are turned by an angle value $\phi$ relative to each other, intersect each other at half the length thereof. This measures ensures in a simple manner that during the travel through the pairs of rollers which follow each other, a secure concentric guidance on each roller is maintained.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIGS. 6, 6*a* and 6*b* are schematic views and a diagram, respectively, showing the necessary free strip lengths L during twisting of strips having different strip widths;

DETAILED DESCRIPTION OF THE PREFERRED EMBODIMENTS

Figure 1:
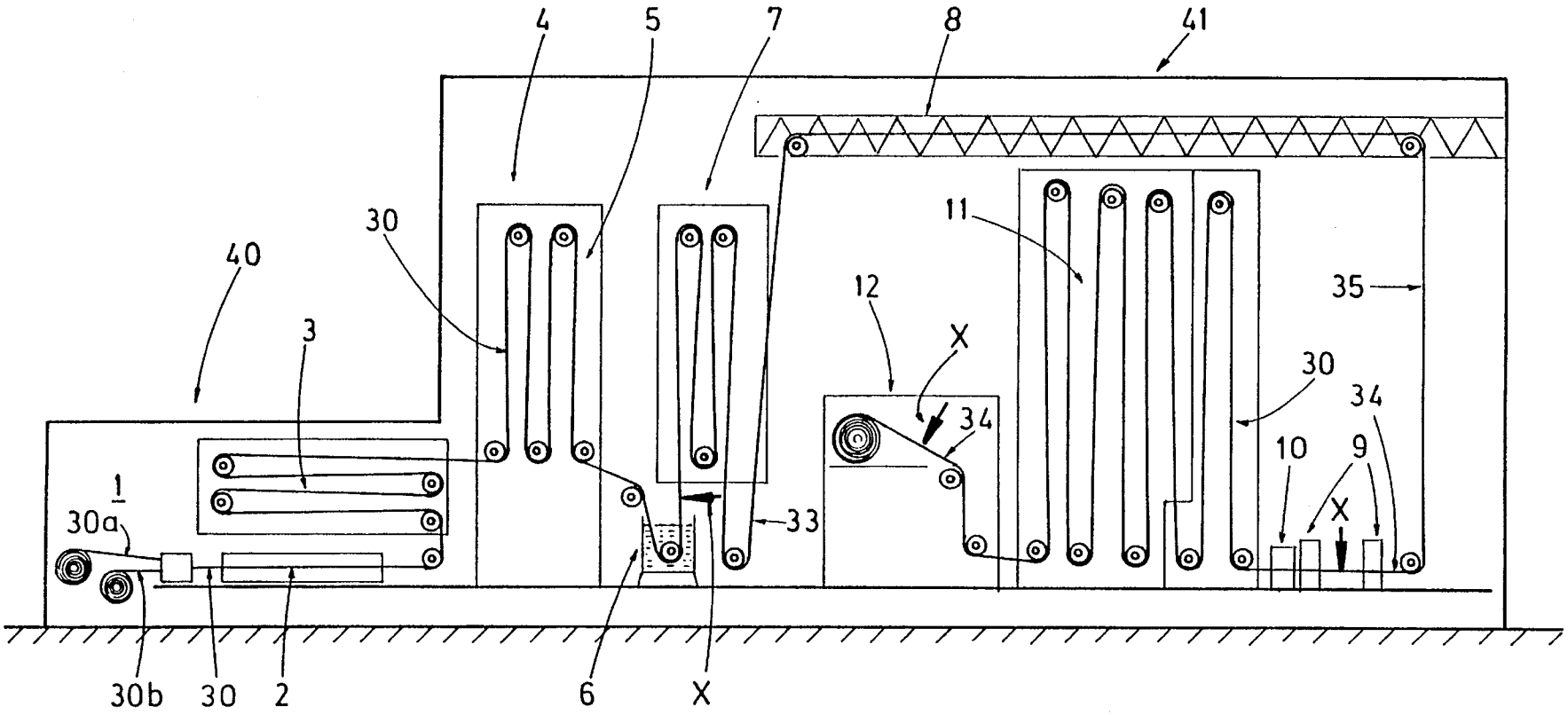
FIG. 1 is a schematic side view of conventional combined hot galvanizing and varnishing plant.

FIG. 1 of the drawing shows a combined hot galvanizing and varnishing plant of conventional configuration with a first low bay portion 40 and an adjacent bay portion 41 which is approximately 40 meters high and 150 meters long. The low bay portion 40 houses the inlet group 1, in which strips 30*a*, 30*b* which can be unwound from two coils are combined into an endless strip 30 and the endless strip 30 is subsequently passed through a degreasing station 2 and a horizontal looping storage 3 following the degreasing station 2, and into the high bay portion 41. In the high bay portion 41, the strip 30 is initially passed through and annealed without tension in an annealing station 4 and, after passing through a subsequently arranged cooling unit 5, the strip 30 is galvanized in the galvanizing station 6. After passing through another cooling stretch 7, the strip is guided vertically upwardly into a steel structure 8 and is guided in the steel structure 8 underneath the roof of the high bay portion 41 horizontally above the plant components 9 to 12 at a height of about 40 meters. At the end of the high bay portion 41, the strip is guided vertically downwardly and then again horizontally in a strip travel direction opposite to the travel direction in the inlet part i for a further treatment initially through skin pass stands 9, then through a stretching/straightening unit 10 and from the latter through the fully automatic varnishing unit 11. The galvanized and varnished strip leaving the varnishing unit 11 is conducted through a vertical exit looping tower adjacent the varnishing unit into the exit group 12 and is wound onto coils in the exit group 12. The strip 30 is subjected to a visual inspection at the locations designated with X, for example, at the exit of the strip 30 from the galvanizing unit 6, between the skin pass stands 9 and in the exit group 12. For this purpose, the original bottom side 33 of the strip 30 is turned over to the strip top side 34. In the conventional configuration of the plant, this is accomplished by turning the strip over 2×90° in the vertical stretch 35 between the steel structure 8 and the inlet in the skin pass stands 9. It is apparent that, because of the height of the bay 41, the length thereof and the necessary high and long steel structure 8, the turnover of the strip 30 is comparatively extremely complicated. Another disadvantage is the inevitably resulting strip travel direction in the opposite direction. Also, there is the danger that the strip is damaged in the high steel structure 8 by travel which is imprecise and difficult to monitor.

Figure 2:
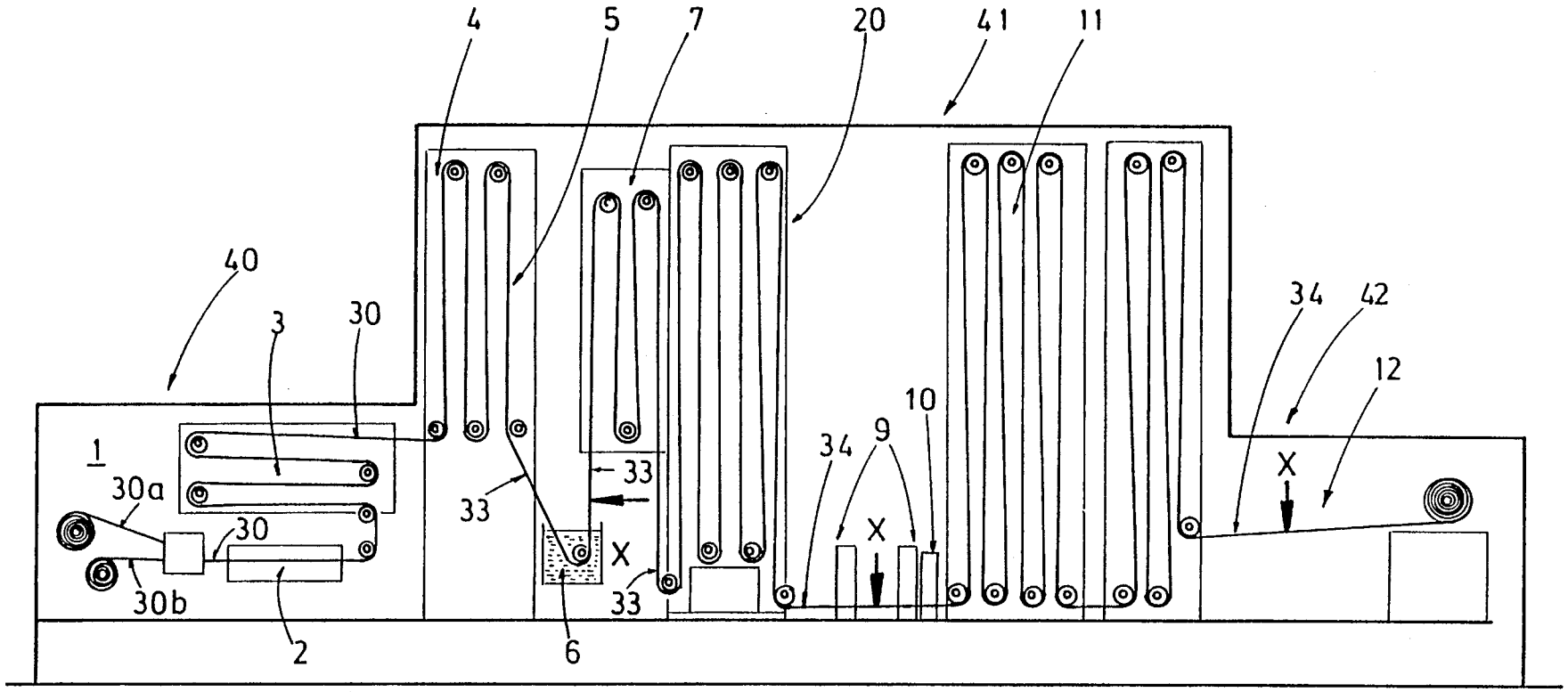
FIG. 2 is a schematic side view of the hot galvanizing and varnishing plant including a strip turning tower according to the present invention.

A plant in accordance with the present invention with a strip turning tower 20 is illustrated in FIG. 2. The strip turning tower 20 is arranged between the galvanizing station 6 and the subsequently arranged cooling stretch 7 and the skin pass stands 9, i.e. approximately in the first third of the high bay portion 41. By including the strip turning tower 20, it is ensured that the high and expensive bay structure is shortened by approximately 40 meters and the shortened portion is replaced by a lower bay portion 42 which receives the exit group 12. The height of the lower bay portion 42 is approximately 15 meters as compared to approximately 35 meters of the high bay portion. The strip 30 entering with the strip bottom side 33 is turned by 180° in the strip turning tower 20 and exits the strip turning tower 20 with the "good side" as the strip top side 34.

Figure 3A:
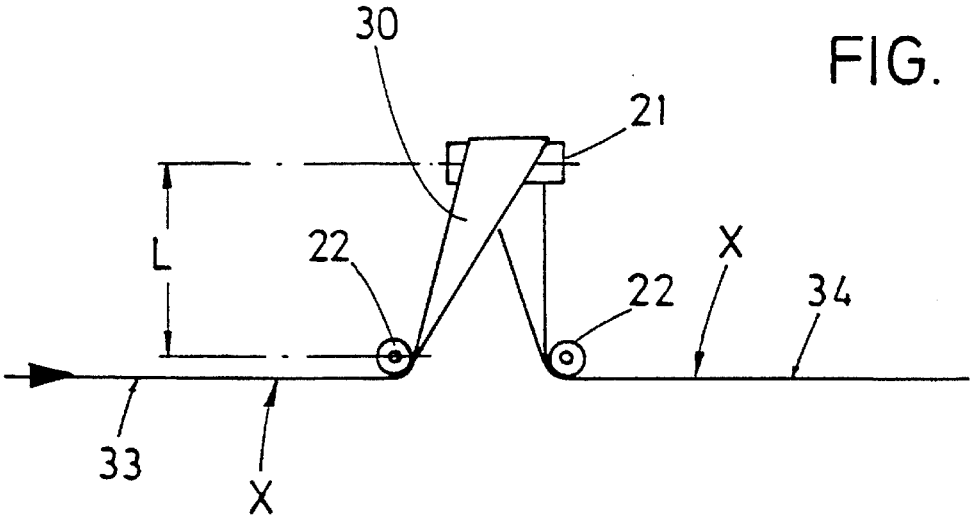
FIGS. 3*a*–3*c* are schematic illustrations of different twisting possibilities during turning of the strip, i.e., 2×90° (FIG. 3*a*), 4×45° (FIG. 3*b*) and 6×60° (FIG. 3*c*)
Figure 3B:
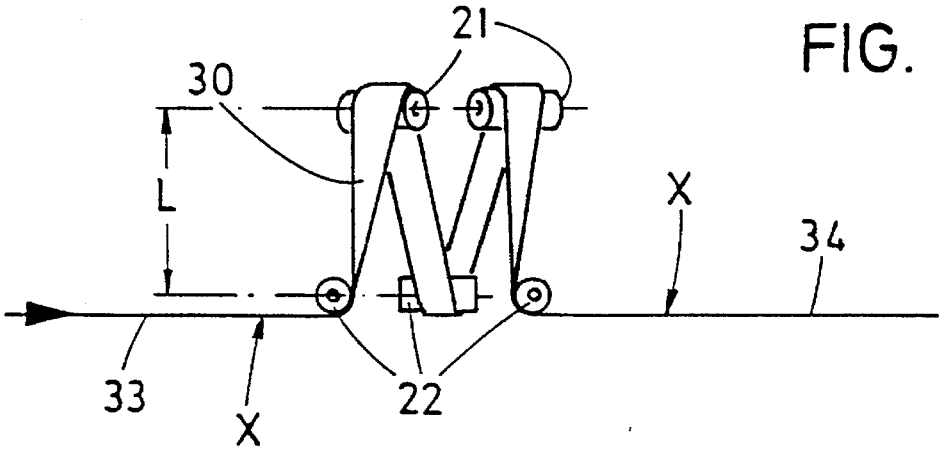
Figure 3C:
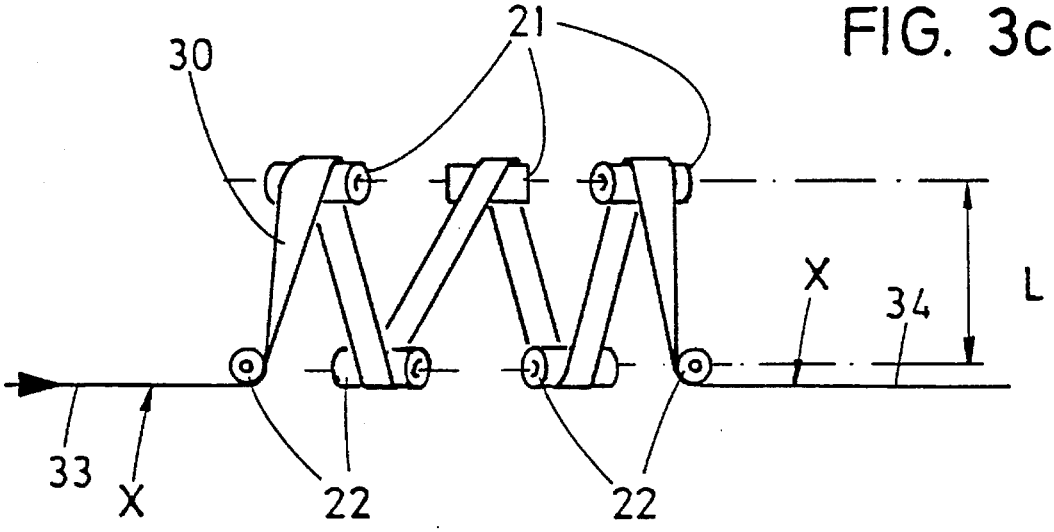

FIGS. 3*a*–3*c* show three examples of the various possibilities of turning the strip by 180°. When the strip is turned with only three rollers 21, 22, as shown in FIG. 3*a*, the strip 30 is twisted by 2×90°; this means that very high edge stresses occur. These edge stresses could only be compensated within acceptable limits by a very long free strip length L; however, this would not be economical. When using five rollers 21, 22 as shown in FIG. 3*b*, four twistings are carried out with an angle of 45° each, i.e., a total of 180°. Even more favorable conditions result in accordance with FIG. 3*c* by six twistings by 30° each by means of seven rollers 21, 22, and with a substantially reduced length L. The same "good sides" of the strip 30 are designated with the inspection side X at the inlet as the bottom side 33 and at the exit as the top side 34.

Figure 4:
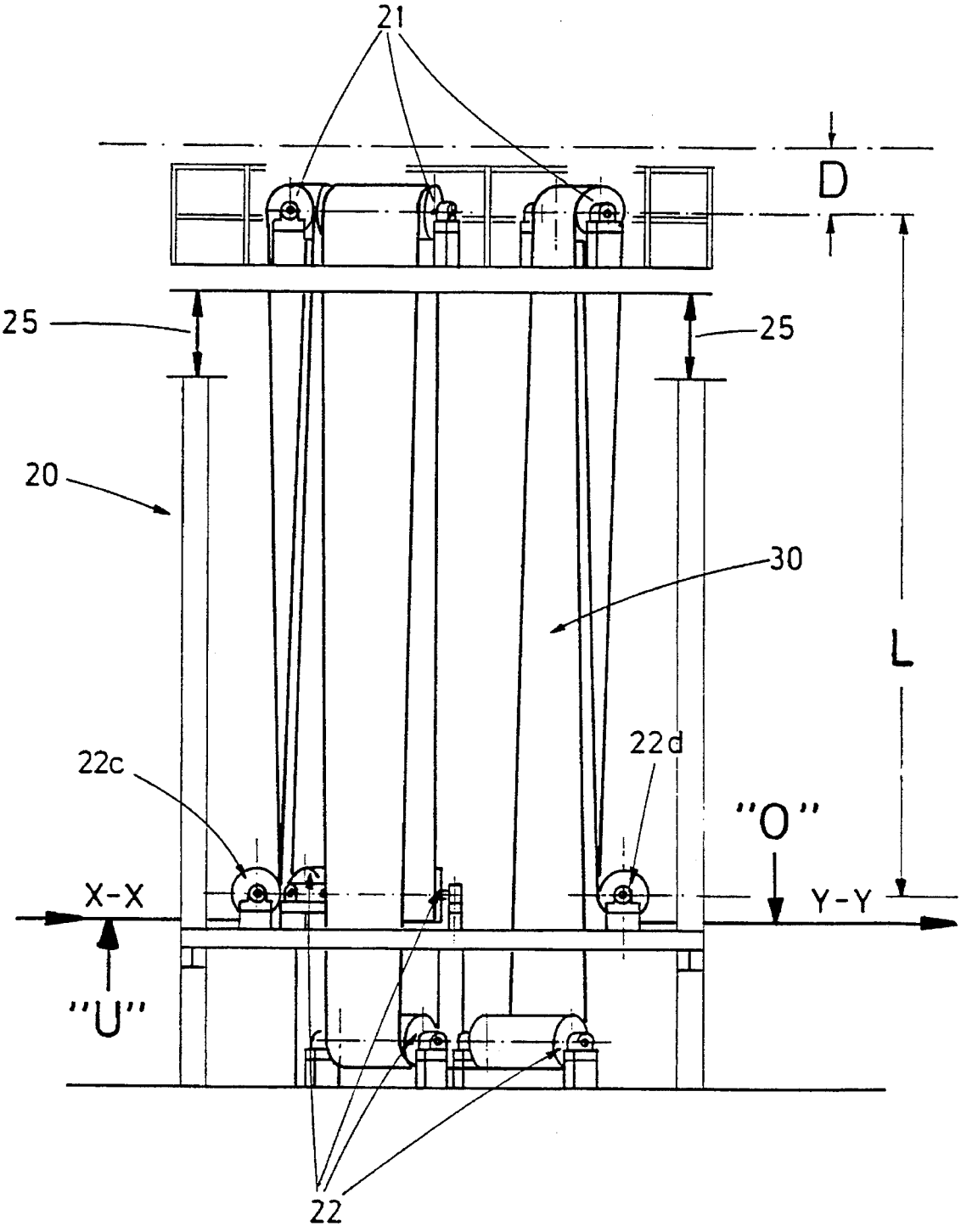
FIG. 4 is a schematic side view of a strip turning tower.

In accordance with the illustration of FIG. 4, the strip turning tower 20 is constructed, similar to a vertical looping storage unit, with a number of upper strip guide rollers 21 and lower strip guide rollers 22 arranged at a vertical distance from each other. The upper strip guide rollers 21 and the lower rollers 22 arranged between the first and the last lower rollers 22*c*, 22*d* are arranged turned relative to the strip inlet axis x—x in travel direction of the strip 30 from roller 21 to roller 22 and vice versa by angles $\phi_1$ to $\phi_n$ which are directed in the same direction and are a cumulative 180°. This-arrangement can be seen particularly well in FIG. 5. As the strip 30 travels around a pair of rollers formed by a lower roller 22 and an upper roller 21, the strip is twisted by the angle $\phi$ and is eventually turned by 180° as a result of the sum of all twisting angles. The vertical length between rollers is designated with L, the strip inlet axis with x—x and the coaxially extending strip exit axis with y—y.

FIG. 4 further schematically shows that the upper guide rollers 21 of the turning unit 20 may include means 25 for adjusting the vertical distance L to the lower rollers 22, 22*c*, 22*d*. Such a possible change in the distance is designated in FIG. 4 by D. The means for adjusting the distance are merely schematically indicated by arrows 25. The upper rollers 21 may include means 25 for adjusting the strip length as well as for keeping the tension condition in the traveling strip 30 constant. These means 25 can be identical to each other and be composed, for example, of piston-cylinder units. FIG. 4 further shows that the strip inlet axis x—x enters with the bottom side U into the strip turning tower 20 and, after twisting of the strip by altogether 180°, leaves the strip turning tower 20 with the same strip side, which is now the top side O, to the strip exit axis y—y.

Figure 5:
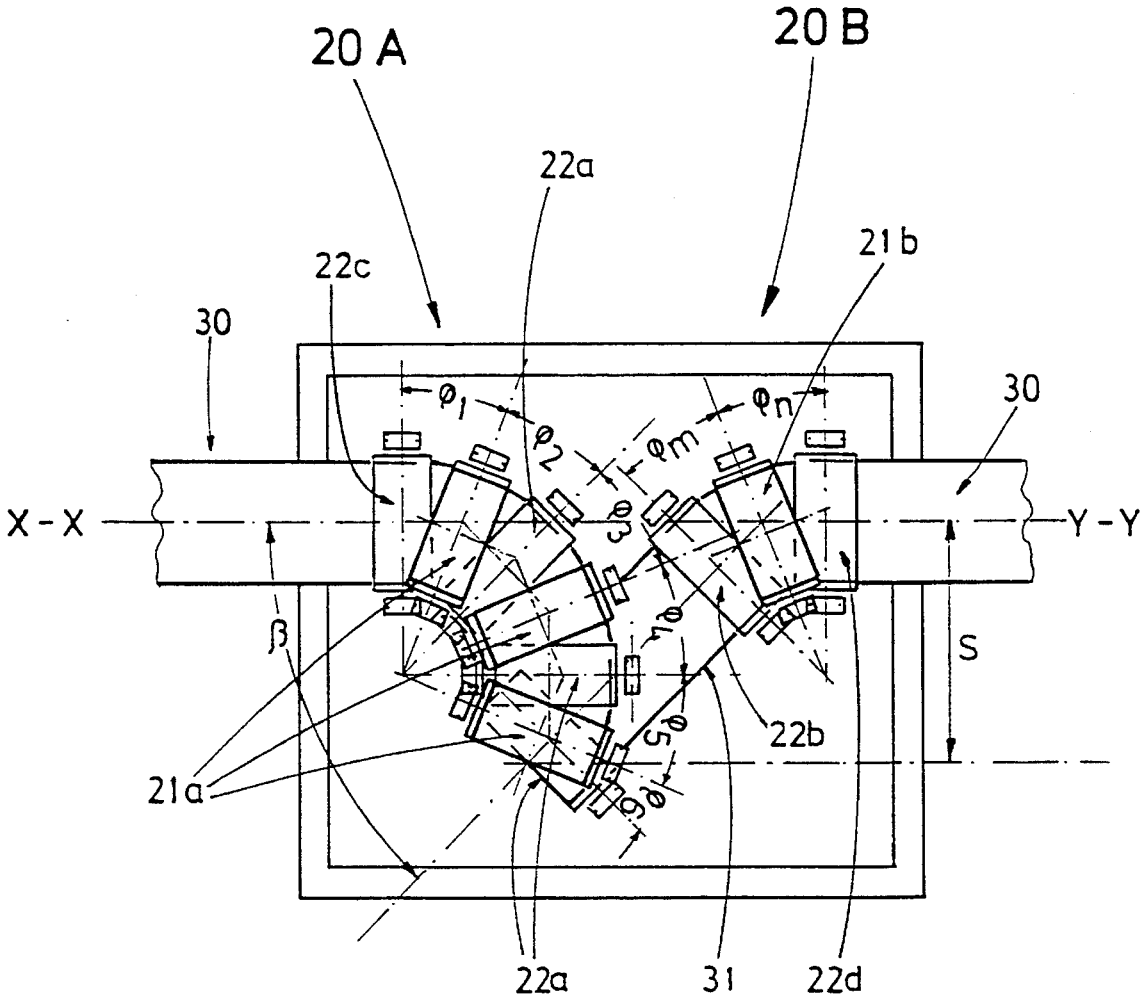
FIG. 5 is a vertical projection of the strip turning tower of FIG. 4.

A return of the strip 30 within the turning tower 20 ensures, if necessary, that the strip travel is maintained in a line from the beginning to the end of the plant and, thus, that the strip inlet axis x—x extends coaxially with the strip exit axis y—y. This is achieved, as shown in FIG. 5 by providing the strip turning unit of the strip turning tower 20 with two groups 20A and 20B of pairs of rollers 21*a*; 22*a* and 21*b*; 22*b*, respectively, which are connected to each other by a straight strip travel stretch 31 of the strip 30 extending at angle $\beta$ relative to the axis x—x. The angles $\phi_1$ to $\phi_n$ of the two groups 20A and 20B together add up to 180°.

FIG. 6*a* schematically shows the twisting of a strip section 32 between an upper roller 21 and a lower roller 22 which are spaced from each other by a distance L. A concentric rolling procedure around the rollers and an exact travel of the strip section 32 is ensured by arranging the upper and lower rollers 21, 22, in the vertical projection of FIG. 6*b*, relative to each other in such a way that the side lines 28 and 29 of two rollers 21 and 22 which guide a common strip section 32 intersect each other in the area of the strip centers x—x and y—y, respectively, of half the strip widths B/2. When this requirement is maintained, the strip section 32 is securely guided with its strip centerlines x—x and y—y over the center of each cambered roller 21 and 22.

The following examples show that the edge elongation during twisting of the strip 30 results in edge stresses. For example, when turning the strip by 90° between two rollers having a distance L between the axes thereof, an edge elongation L plus $\delta L$ results in accordance with the following computation:

For example, for twisting by 90° with

B=1,500 mm and

Figure 7A:
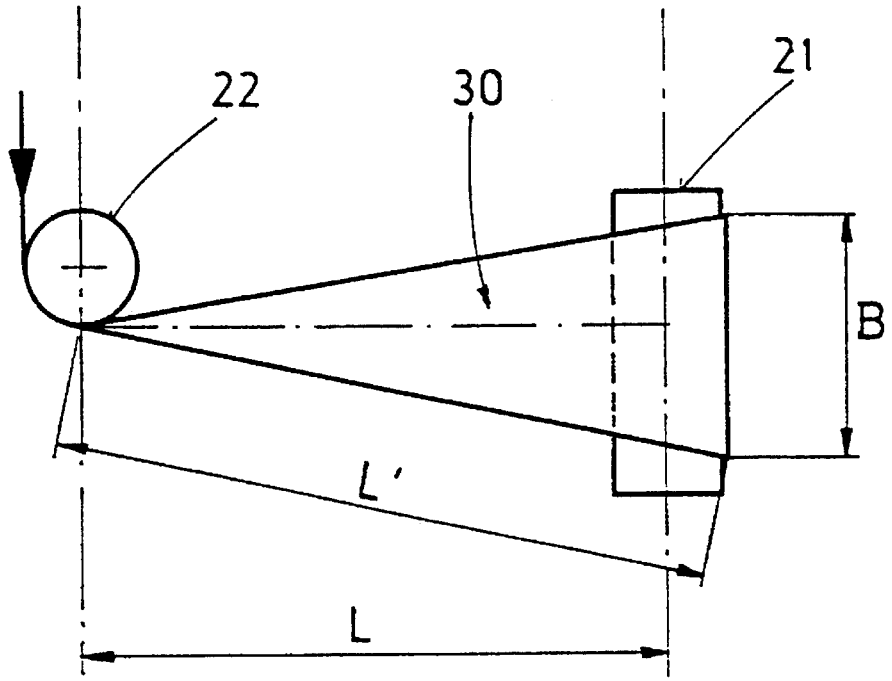
FIGS. 7*a*–7*b* are schematic views showing the compensation of edge stresses caused by twisting by means of cambered guide rollers.
Figure 7B:
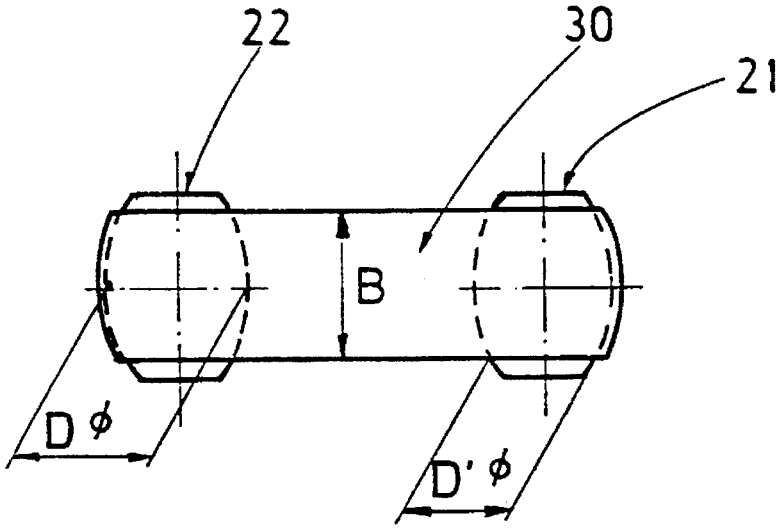

L=30,000 mm, the following results in accordance with FIG. 7*a*:

$$L+\delta L=\sqrt{L^2+(B/2)^2} \quad (1)$$

-continued $$\delta L\,(\%) = (\sqrt{L^2 + (B/2)^2} - L) * 100/L \quad (2)$$

$$\delta L\,(\%) = 0.0312\%$$

$$\delta L/L = \sigma/E;\ \sigma = \delta L * E/L \quad (3)$$

$$\sigma = 65.6\ \mathrm{N/mm^2}$$

Wherein:

B=strip width

L=distance between the axes of the rollers

δL=edge elongation

σ=resulting edge stress

E=modulus of elasticity of the strip material

Calculating roughly, this results at a twisting angle of ϕ=30° approximately 30% in σ=22 N/mm$^2$ with δL=3.1 mm. Consequently, the necessary camber for compensating the strip edge stress σ is assumed at δD=D—D'=3.1 mm.

During twisting, the length of the centerline of the strip remains unchanged, while the edges become longer in accordance with the law of a helical line. Thus:

$$L' = \sqrt{L^2 + (B * \pi * \phi/360)^2} = \sqrt{1 + (B * \pi * \phi/L/360)^2}$$

The second expression in the root is always small as compared to the number 1, so that the following approximation applies:

L'=L[1=½ (B*π*ϕ/L/360)2]

This results in an elongation of the strip edges:

$$\epsilon_R = \delta L/L = (L' - L)/L = (L'/L) - 1$$
$$= 1/2\ (B * \pi * \phi/L/360)^2$$

The elongation must be produced by the tensile force in the strip, wherein the force decreases linearly toward the center of the strip.

$$\epsilon_m = \epsilon_R/2 = \sigma_m/E$$
$$= F_z/(B * h * E)$$
$$= 1/4\ (B * \pi * \phi/L/360)^2$$

A twisting ϕ=90° results in $F_z/(B * h * E)$=¼ $(\pi/4 * B/L)^2$

Resolved in accordance with twisting lengths L, this results in:

$$L = \pi/8 * \sqrt{B^3 * h * E/F_Z}$$

$$L = B * \pi * \phi/720 * \sqrt{E/F_{spez}}$$

Figure 6:
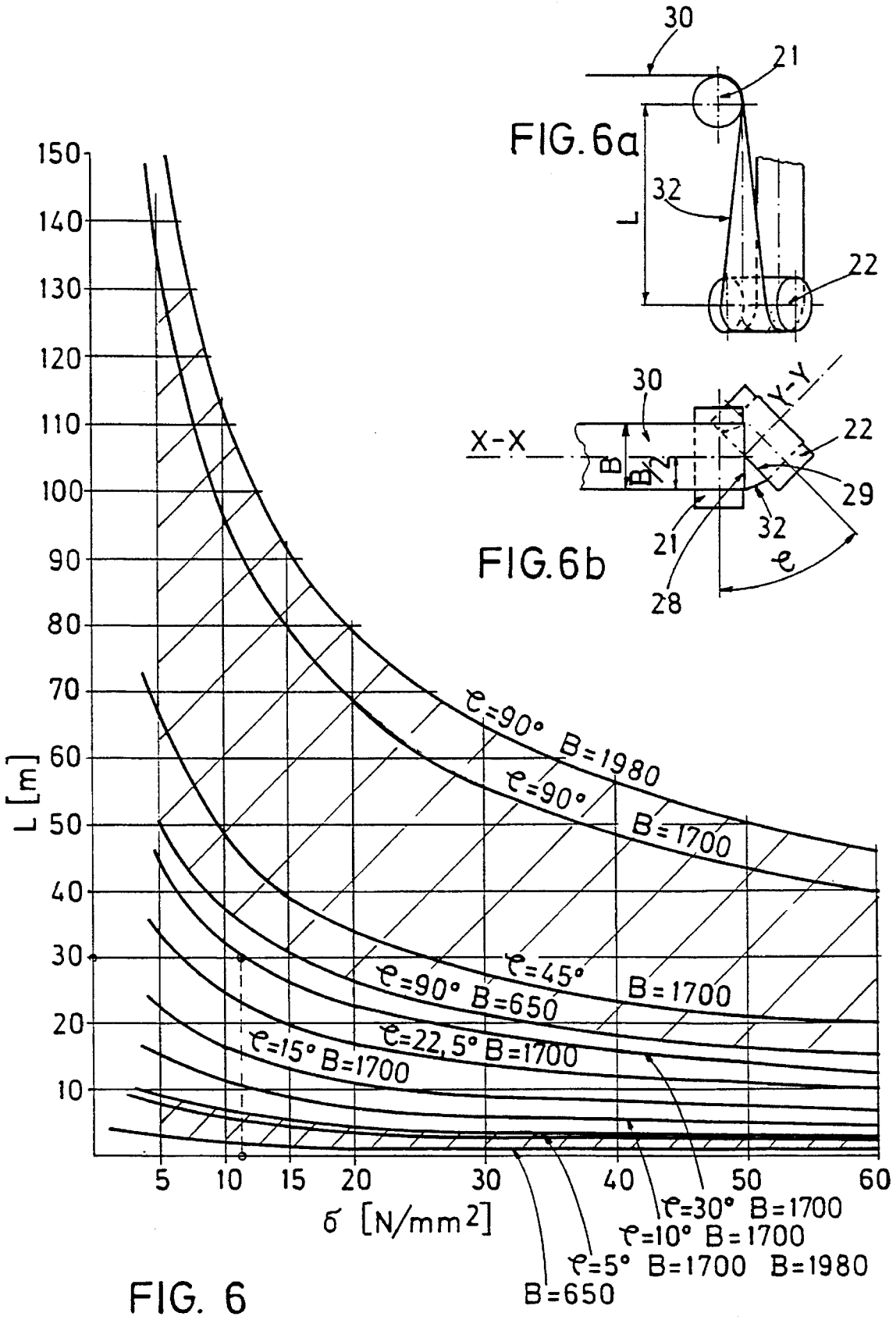

Wherein:

ϵ=the strip tension to be produced by the strip force $\epsilon_R$=elongation $\epsilon_m$=average elongation across the width of the strip $F_Z$=permissible strip force $F_{spez}$=specific strip tension h=strip thickness ϕ=twisting angle In accordance with these computations, the required free strip lengths L for strip widths B between 650 and 1980 mm for various twisting angles ϕ between the rollers 21 and 22 result in dependence on a specific strip tension $F_{spez}$ and the edge stress σ N/mm$^2$ and correspondingly the necessary lengths L between rollers in meters in accordance with the diagram of FIG. 6. In the present embodiment according to the invention, six deflections of an angle ϕ of 30° each at a strip width B=1700 mm and a length L of 30 m were selected. The diagram according to FIG. 6 shows that these conditions result in a specific strip tension $F_{spez}$ of about 12N/mm$^2$.

In accordance with the computation, the guide rollers 21 and are of cambered configuration. The diameter difference δD between center D and end face D' of a cambered roller 21, 22 approximately corresponds to the dimension of the edge elongation δL caused by twisting of the strip 30 about an angle ϕ with a constant distance L between the axes of the rollers 21 and 22.

An embodiment illustrates these conditions for a practical case as follows:

| | |
|---|---|
| Strip thickness: | 0.2–0.8 mm |
| Strip width: | 750–1,500 mm |
| Free length between roller axes: | about 30 m |
| Roller diameter: | about 800 mm |
| Angle of deflection for each pair of rollers: | 30° |

The increased edge stresses resulting from twisting are certain to be within the elastic range and are compensated by a suitable selection of the cambers of the rollers.

The roller cambers, for example, 3 to 4 mm in diameter at 800 mm roller diameter and 1,800 mm roller length, additionally ensure a self-centering effect and, thus, an exact travel of the strip. Strip centering control units are preferably arranged in front of and behind the strip turning tower.

By using a strip turning tower 20 for guiding and turning the strip 30, the present invention provides a clear and uncomplicated unit which can be utilized at any desired location of the plant. The present invention additionally makes it possible to reduce the height and the length of the large bay, so that the costs are substantially reduced, and a travel of the strip 30 in the same direction from the entry station 1 to the exit station 12 of the plant is achieved. Additional costs are saved and technical advantages achieved by the fact that the strip turning tower 20 may include means 25, in the manner of a vertical looping storage unit, for strip length compensation and/or for maintaining a constant tension condition of the strip 30.

Moreover, the present invention makes it possible to adjust the desired strip travel direction and to deflect the strip with a parallel displacement from a first travel track into a second travel track arranged at a distance from the first travel track. This makes it possible in an uncomplicated manner to guide the strip through various components of an overall plant.

Figure 8:
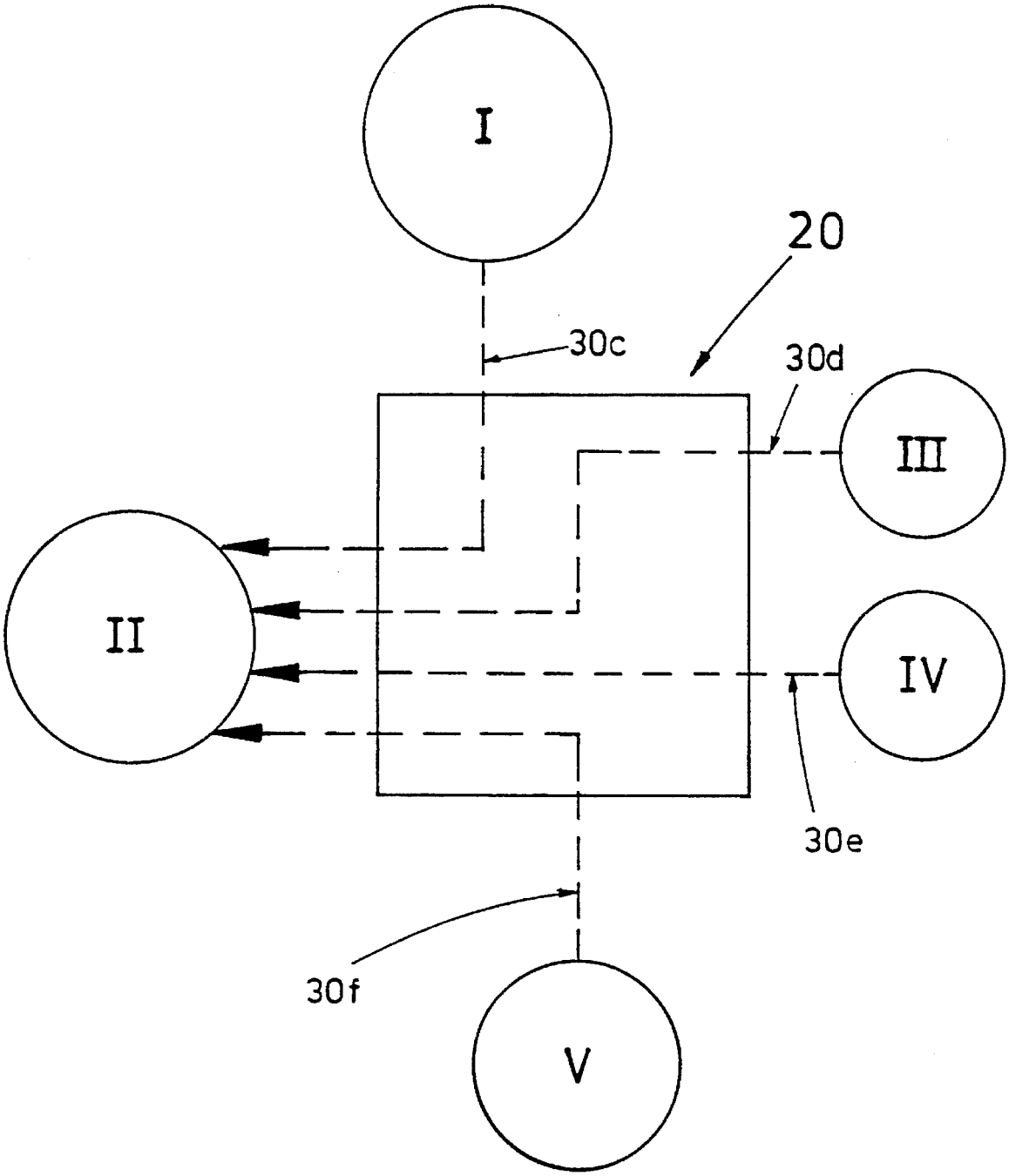
FIG. 8 is a schematic illustration of a strip turning tower with peripherally connected transport tracks for transporting the strip between different treatment stations of a plant.

An example of the strip guidance is illustrated schematically in FIG. 8. Thus, a strip 30*c* is introduced from plant component I into the strip turning tower 20 and is twisted by 90° in the strip travel direction in the strip turning tower 20 and the strip 30*c* is subsequently guided from the tower 20 to the plant component II. The strip 30*d* is introduced from the plant component III into the tower 20 and is turned in the tower 20 and is conveyed further with a parallel shift out of the tower 20 and into the plant component II. The strip 30*e* is introduced from the plant component IV, is turned in the tower 20 and is subsequently further conveyed into the plant component II. The strip 30*f* is introduced from the plant component V into the tower 20, is twisted in the tower in its travel direction by 90° and, without having been turned, is conveyed further from the tower 20 into the plant component II.

The examples of the guidance of the strip illustrated in FIG. 8 can be carried out in an appropriately constructed strip turning tower 20 either individually or simultaneously in any combination thereof. The examples shown in FIG. 8 merely serve as an illustration of the various possibilities for guiding the strip into the tower 20, depending on the configuration of the tower 20 with one or more groups of vertically spaced-apart guide rollers.

The invention is not limited by the embodiments described above which are presented as examples only but can be modified in various ways within the scope of protection defined by the appended patent claims.

We claim:

1. A method of guiding a steel strip during travel of the steel strip through a continuous strip treatment plant including a plurality of treatment stations, the strip traveling in a travel direction and in at least one travel track, wherein the travel direction and the travel track of the strip can be adjusted as desired and the strip can be turned as desired from a bottom side to a top side and vice versa, the method comprising introducing the strip into a strip turning tower, the strip turning tower having a strip entry and a strip exit, the strip turning tower further including a plurality of upper guide rollers and a plurality of lower guide rollers, wherein the upper and lower guide rollers are cambered and vertically spaced apart from each other, the method further comprising guiding the strip alternatingly around the upper and lower guide rollers and twisting the strip by means of each roller by an angle until twisting of the strip by means of the rollers between strip entry and strip exit results in a total twisting angle of the strip, further comprising adjusting a diameter difference between the diameters of each roller at a middle and a side thereof which determines the camber of the roller, wherein the diameter difference corresponds approximately to an edge elongation caused by twisting of the strip by a certain angle with a given free strip length L between a pair of rollers and causing an elongation of strip edge areas, wherein $$L = B * \pi * \phi/720 * \sqrt{E/F_{spez}}$$

wherein

B=strip width $\phi$=twisting angle

E=modulus of elasticity of the present material $F_{spez}$=specific strip tension.

2. The method according to claim 1, comprising twisting the strip by a total angle of 180°, wherein after guiding the strip around a last roller of the strip turning tower, a bottom side of the strip entering the first roller is turned in the strip turning tower to the top side of the strip when the strip leaves the strip turning tower.

3. The method according to claim 1, comprising, for adjusting a parallel shift between two travel tracks, swinging the strip in the strip turning tower by an angle deviating from a direction of an entry track by guiding the strip through a first group of rollers, and, after traveling through an intermediate straight stretch corresponding to the parallel shift, introducing the strip into a second group of guide rollers and swinging the strip back in the second group of guide rollers into the direction of the entry track.

4. The method according to claim 1, comprising, for compensating a lateral displacement caused by the guide rollers during turning of the strip, twisting the strip in a first group of guide rollers by an angle of more than 180°, guiding the strip in an inclined angle relative to a strip entry axis from a last lower roller along a longitudinal stretch into a direction toward a strip exit axis by an extent corresponding to the lateral displacement into a second group of guide rollers, and twisting the strip back by an angle resulting in guidance of the strip in the strip exit axis extending coaxially to the direction of the strip entry axis.

5. The method according to claim 1, comprising compensating length differences and Stress differences of the strip within the strip turning tower by changing the distances between the lower guide rollers and the upper guide rollers.

6. The method according to claim 1, comprising determining a permissible angle value of the strip between an upper guide roller and a lower guide roller in accordance with a ratio of a free length of the strip between the upper and lower rollers relative to the strip width and the resulting edge stress of the strip.

* * * * *